United States Patent [19]

Nagasaka et al.

[11] Patent Number: 4,513,650

[45] Date of Patent: Apr. 30, 1985

[54] ELECTRONIC MUSICAL INSTRUMENT

[75] Inventors: Nobuyuki Nagasaka; Yukichi Momoshima, both of Tokyo, Japan

[73] Assignee: Kabushiki Kaisha Daini Seikosha, Tokyo, Japan

[21] Appl. No.: 482,918

[22] Filed: Apr. 7, 1983

[30] Foreign Application Priority Data

Apr. 16, 1982 [JP] Japan ..... 57-63286

[51] Int. Cl.[3] ..... G10F 1/00

[52] U.S. Cl. ..... 84/1.03; 84/1.01

[58] Field of Search ..... 84/1.01, 1.03, 1.24

[56] References Cited

U.S. PATENT DOCUMENTS 4,318,326 3/1982 Howell ..... 84/1.03

*Primary Examiner*—Forester W. Isen

*Attorney, Agent, or Firm*—Robert E. Burns; Emmanuel J. Lobato; Bruce L. Adams

[57] ABSTRACT

In a keyboard instrument having white and black keys, the necessity for a player to depress black (sharp or flat) keys is eliminated by circuitry which memorizes which tones are to be automatically sharped or flatted when a corresponding white key is depressed.

11 Claims, 1 Drawing Figure

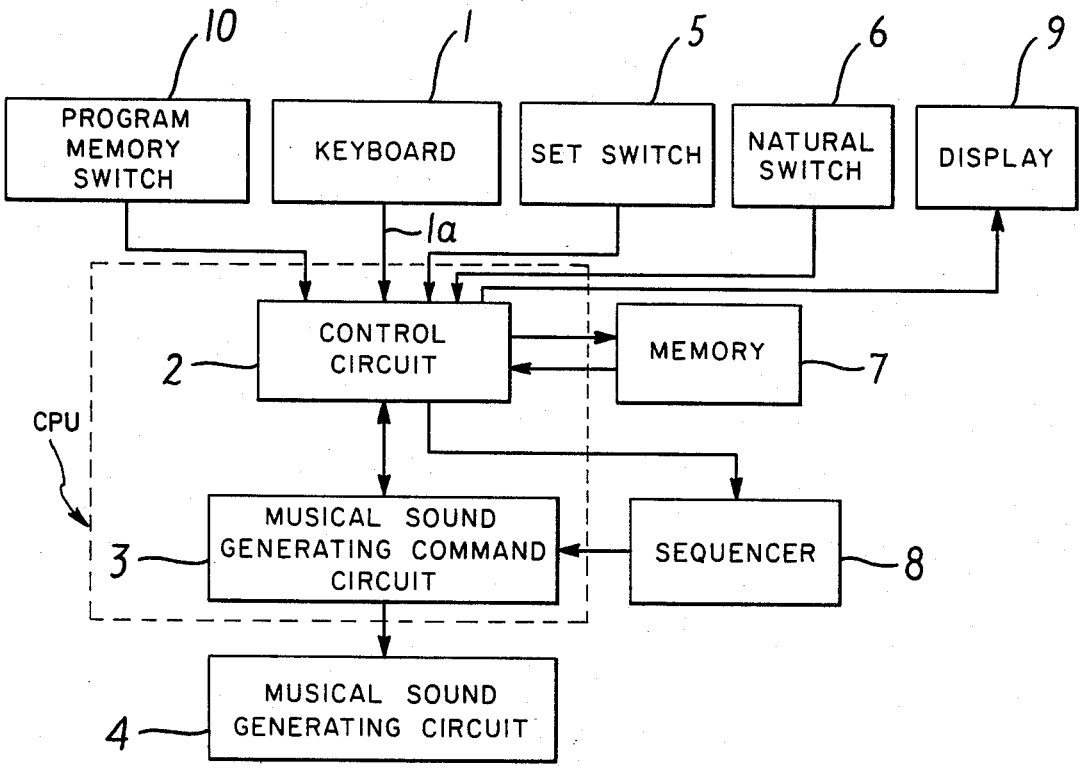
10
1
5
6
9
PROGRAM MEMORY SWITCH
KEYBOARD
SET SWITCH
NATURAL SWITCH
DISPLAY
1a
CONTROL CIRCUIT
2
MEMORY
7
CPU
MUSICAL SOUND GENERATING COMMAND CIRCUIT
3
SEQUENCER
8
MUSICAL SOUND GENERATING CIRCUIT
4

ELECTRONIC MUSICAL INSTRUMENT

BACKGROUND OF THE INVENTION

The present invention relates generally to an electronic musical keyboard instrument, and more particularly to such an instrument having means to automatically transfer a semitone for playing a melody without a melody in which a sharp and flat are not added thereto namely A-minor and C-major.

In the conventional type electronic musical keyboard instrument, in case of playing a melody without C-major and A-minor, a player has to transfer a semitone in the up and down mode and memorize said semitone. Namely, it is very difficult to play a melody for a beginner in which a flat and sharp are added thereto.

The present invention aims to eliminate the above noted difficulty and insufficiency, and it is the object of the present invention to provide an effective yet simple means for playing a melody. The electronic musical instrument according to one form of the invention is composed of a keyboard, set switch, natural switch, memory circuit, control circuit, musical sound generating command circuit and musical sound generating circuit, and is able to automatically transfer a semitone in the up and down modes against a set tone when the player plays a melody using only the white keys by memorizing the tone names having a flat or sharp therein. The flat and sharp tone names can be eliminated or in case of a natural melody by-passed by operating the natural switch. Further, a combination of many kinds of melodys of flat and sharp can be memorized by means of said program memory switch.

BRIEF DESCRIPTION OF THE DRAWINGS

The FIGURE shows a circuit block diagram of an embodiment of the present invention.

The FIGURE shows a keyboard 1 connected to a control circuit 2 for transferring and controlling signals to other circuit blocks according to the keyboard signals input from said keyboard 1, a set switch 5, natural switch 6 and a program memory switch 10. A musical sound generating command circuit 3 is connected to a musical sound generating circuit 4. The set switch 5 applies a tone name and number of flat and sharp to a memory 7, and the natural switch 6 resets a semitone transfer when a natural mark is displayed. The memory 7 is for memorizing tone name information of flat and sharp and information from a program memory switch 10. A sequencer 8 for automatically playing and memorizing a chord or melody of music may optionally be added.

A display portion 9 is provided for displaying the informations input by the set switch 5, program memory switch 10, natural switch 6 and memory 7, and the program memory switch 10 has the function of memorizing and reading a number of sharps and flats of many kinds of melodys.

Therefore, if a player sets or reads in a tone name of flat and sharp to said memory 7 from said set switch 5 and keyboard 1, the player is able to automatically play a melody with flat and sharp by automatically transferring a semitone by reading out the semitone information from the memory 7. For example, in case of playing a melody with three flats, first of all, a player has to read in a tone name by said switch 5 and kayboard 1. Namely, a player has to memorize data in said memory 7 corresponding to the tone names having flats B, E and A. Then, if the player plays said tones without semitone transfer only by the white keys (whole tone keys), the tones B, E and A are automatically changed and generated as the semitones $B^{\flat}$, $E^{\flat}$ and $A^{\flat}$.

The circuit operation of the present invention will now be described. The control circuit 2 is operated by key informtion generated from said keyboard 1 and a musical sound is generated from said musical sound generating circuit 4. A semitone transfer is read in and memorized by the memory 7 through the said control circuit 2 to said memory 7 in case of applying a key information of said keyboard 1 while concurrently operating said set switch 5. This operation is called a semitone transfer information, operation and the transferred information is displayed on said display portion 9. A plurality of kinds of such informations are memorized in said memory 7 by operating said program memory 10, set switch 5 and keyboard 1 and such informations are displayed on said display portion 9. Under this condition, key information is controlled by said control circuit 2 according to said semitone transfer information memorized in said memory 7, whereby a musical sound is generated by said musical generating circuit 4. Therefore, as mentioned above, the player is able to play a melody with a flat or sharp in an automatic semitone transfer mode by using only the white keys. Then, if a player wishes to change the information, the player is able to command and read another kind of semitone transfer information by simply operating said program memory switch 10. Further, the player is able to select a preferable kind of tone name only and reset said semitone transfer information by operating said natural switch 6 when a natural mark is displayed in a musical note during a playing time.

In the case of having the sequencer 8, the semitone transfer information is applied to said sequencer 8 as a semitone is pushed by the keyboard whereby an autoplay mode is easily executed.

As another embodiment of the present invention, which is shown by dashed lines in the drawing, a CPU can be used instead of the control circuit 2 and musical sound generating command circuit 3. Further the player is able to apply a flat and sharp to the CPU according to the pushed number of white keys (whole tone keys) and black keys (semitone keys).

According to the present invention, the player is able to apply semitone transfer information to the memory 7 by operating the set switch 5. Further the player is able to apply semitone transfer information of many kinds of melodies to said memory 7 by operating said program memory switch 10, and a memorized tone name in the first time is automatically transferred in the up and down mode of semitone by said semitone transfer information operation when a white key only is pushed since the key information from said keyboard 1 is controlled by said control circuit 2. Therefore, the player is able to easily play a difficult melody which includes C-major and A-minor without flat or sharp by only the white keys so as to play C-major since a semitone is automatically transferred.

We claim:

1. An electronic musical instrument comprising in combination: a keyboard having a plurality of white and black keys operative when depressed to produce corresponding key signals; a control circuit connected to receive the key signals; a musical sound generating circuit controlled by the key signals from said control circuit; a set switch operable to apply a semitone transfer information signal to said control circuit; a memory circuit for memorizing the semitone transfer information corresponding to certain depressed black keys according to an output signal from said set switch; said control circuit being operative to automatically transfer a semitone of said key information according to said semitone transfer information memorized in said memory whereby the instrument can play a semitone difference sound by actuation of only the white keys.

2. In an electronic musical keyboard instrument of the type having a plurality of whole tone keys and a plurality of semitone keys operative when actuated for producing corresponding keyboard signals representative of whole tones and semitones, and musical sound generating means responsive to the keyboard signals for generating corresponding musical sounds: memory means for memorizing semitone information; set switching means operable when actuated for enabling semitone information to be stored in the memory means; and control means for controlling the reading in of semitone information into the memory means from the keyboard when both the semitone keys and set switching means are actuated, and for controlling the reading out of semitone information from the memory means in the form of semitone keyboard signals according to the actuation of selected ones of the whole tone keys during playing of the keyboard and for applying the semitone keyboard signals to the musical sound generating means.

3. An electronic musical keyboard instrument according to claim 2; including natural switching means coacting with the control means and operative when actuated to by-pass the memory means so that the control means controls the application of keyboard signals to the musical sound generating means corresponding to the actuated whole tone keys during playing of the keyboard.

4. An electronic musical keyboard instrument according to claim 3; wherein the control means comprises a control circuit, and a musical sound generating command circuit.

5. An electronic musical keyboard instrument according to claim 3; wherein the control means comprises a CPU.

6. An electronic musical keyboard instrument according to claim 3; including display means connected to the control means for displaying information indicative of the semitone information read into the memory means.

7. An electronic musical keyboard instrument according to claim 3; including program memory switching means coacting with the control means for enabling a plurality of kinds of semitone information to be read into the memory means.

8. An electronic musical keyboard instrument according to claim 2; wherein the control means comprises a control circuit, and a musical sound generating command circuit.

9. An electronic musical keyboard instrument according to claim 2; wherein the control means comprises a CPU.

10. An electronic musical keyboard instrument according to claim 2; including display means connected to the control means for displaying information indicative of the semitone information read into the memory means.

11. An electronic musical keyboard instrument according to claim 2; including program memory switching means coacting with the control means for enabling a plurality of kinds of semitone information to be read into the memory means.

* * * * *